US005851140A

United States Patent [19]

Barns et al.

[11] Patent Number: 5,851,140

[45] Date of Patent: Dec. 22, 1998

[54] SEMICONDUCTOR WAFER POLISHING APPARATUS WITH A FLEXIBLE CARRIER PLATE

[75] Inventors: Chris E. Barns, Portland, Oreg.; Malek Charif, Tempe, Ariz.; Kenneth D. Lefton, Beaverton, Oreg.; Fred E. Mitchel, Phoenix, Ariz.

[73] Assignee: Integrated Process Equipment Corp., Phoenix, Ariz.

[21] Appl. No.: 800,941

[22] Filed: Feb. 13, 1997

[51] Int. Cl.[6] ..... B24B 5/00

[52] U.S. Cl. ..... 451/288; 451/398; 451/289

[58] Field of Search ..... 451/288, 289, 451/287, 285, 41, 398, 286

[56] References Cited

U.S. PATENT DOCUMENTS

| | | | |
|---|---|---|---|
| 3,449,870 | 6/1969 | Jensen | 51/216 |
| 3,841,031 | 10/1974 | Walsh | 51/283 |
| 3,857,123 | 12/1974 | Walsh | 51/131 |
| 4,132,037 | 1/1979 | Bonora | 51/131 |
| 4,239,567 | 12/1980 | Winings | 156/154 |
| 4,270,316 | 6/1981 | Kramer | 51/283 |
| 4,313,284 | 2/1982 | Walsh | 51/131.4 |
| 4,508,161 | 4/1985 | Holden | 165/1 |
| 4,671,145 | 6/1987 | Fehrenbach et al. | 81/1 |
| 4,918,869 | 4/1990 | Kitta | 51/131.1 |
| 5,029,418 | 7/1991 | Bull | 51/281 |
| 5,036,630 | 8/1991 | Kaanta et al. | 51/283 |
| 5,081,795 | 1/1992 | Tanaka et al. | 51/131.1 |
| 5,193,316 | 3/1993 | Olmstead | 51/281 |
| 5,205,082 | 4/1993 | Shendon et al. | 51/283 |
| 5,398,459 | 3/1995 | Okumura et al. | 451/41 |
| 5,423,558 | 6/1995 | Koeth et al. | 279/3 |
| 5,423,716 | 6/1995 | Strasbaugh | 451/289 |
| 5,449,316 | 9/1995 | Strasbaugh | 451/289 |
| 5,527,209 | 6/1996 | Volodarsky et al. | 451/388 |
| 5,564,965 | 10/1996 | Tanaka et al. | 451/287 |
| 5,584,746 | 12/1996 | Tanaka et al. | 451/41 |
| 5,624,299 | 4/1997 | Shendon | 451/289 |

FOREIGN PATENT DOCUMENTS

| | | | |
|---|---|---|---|
| 4013567 | 1/1992 | Japan | 451/364 |
| 4171170 | 6/1992 | Japan | 451/290 |
| 6091522 | 4/1994 | Japan | 451/288 |

*Primary Examiner*—Robert A. Rose
*Attorney, Agent, or Firm*—Quarles & Brady

[57] ABSTRACT

A carrier head for a semiconductor wafer polishing apparatus includes a rigid plate which has a major surface with a plurality of open fluid channels. A flexible wafer carrier membrane has a perforated wafer contact section for contacting the semiconductor wafer, and a bellows extending around the wafer contact section. A retaining ring is secured to the rigid plate with a flange on the bellows sandwiched between the plate's major surface and the retaining ring, thereby defining a cavity between the wafer carrier membrane and the rigid plate. A fluid conduit is coupled to the rigid plate allowing a source of a vacuum and a source of pressurized fluid alternately to be connected to the cavity.

19 Claims, 2 Drawing Sheets

SEMICONDUCTOR WAFER POLISHING APPARATUS WITH A FLEXIBLE CARRIER PLATE

FIELD OF THE INVENTION

The present invention relates to semiconductor processing equipment, and more particularly to carriers for holding a semiconductor wafer during polishing.

Semiconductor wafers are polished to achieve a smooth, flat finish before performing process steps that create electrical circuits on the wafer. This polishing is accomplished by securing the wafer to a carrier, rotating the carrier and placing a rotating polishing pad in contact with the rotating wafer. The art is replete with various types of wafer carriers for use during this polishing operation. A common type of carrier is securely attached to a shaft which is rotated by a motor. A wet polishing slurry, usually comprising a polishing abrasive suspended in a liquid, was applied to the polishing pad. A downward polishing pressure was applied between the rotating wafer and the rotating polishing pad during the polishing operation. This system required that the wafer carrier and polishing pad be aligned perfectly parallel in order to properly polish the semiconductor wafer surface.

The wafer carrier typically was a hard, flat plate which did not conform to the surface of the wafer which opposite to the surface being polished. As a consequence, the carrier plate was not capable of applying a uniform polish pressure across the entire area of the wafer, especially at the edge of the wafer. In an attempt to overcome this problem, the hard carrier plate often was covered by a softer carrier film. The purpose of the film was to transmit uniform pressure to the back surface of the wafer to aid in uniform polishing. In addition to compensating for surface irregularities between the carrier plate and the back wafer surface, the film also was supposed to smooth over minor contaminants on the wafer surface. Such contaminants could produce to high pressure areas in the absence of such a carrier film. Unfortunately, the films were only partially effective with limited flexibility and tended to take a "set" after repeated usage. In particular, the set appeared to be worse at the edges of the semiconductor wafer.

Another adverse effect in using conventional apparatus to polish semiconductor wafers was greater abrasion in a small region adjacent to the edge of the semiconductor wafer. This edge effect resulted from two main factors, assuming a uniform polishing velocity over the wafer surface, (1) pressure variation (from the nominal polish pressure) close to the edge area and (2) interaction between the polish pad and the edge of the semiconductor wafer.

This latter factor was due to the carrier pressure pushing the wafer into the rotating polishing pad. Thus the polishing pad was compressed beneath the wafer and expanded to its normal thickness elsewhere. The leading edge of the wafer was required to push the polishing pad downward as it rode over new sections of the pad. As a consequence, an outer annular region of each wafer was more heavily worn away and could not be used for electronic circuit fabrication. It is desirable to be able to utilize the entire area of the wafer for electronic circuit fabrication.

BACKGROUND OF THE INVENTION

A general object of the present invention is to provide an improved wafer carrier mechanism for polishing semiconductor wafers.

Another object is to provide a carrier which applies uniform pressure over the entire area of the semiconductor wafer.

A further object of the present invention is to provide a surface on the carrier which contacts the back surface of the semiconductor wafer and conforms to any irregularities of that back surface. Preferably, the surface of the carrier plate should conform to even minute irregularities in the back surface of the semiconductor wafer.

Yet another object is to provide a carrier plate which eliminates the greater erosion adjacent the semiconductor wafer edge as produced by previous carriers.

These and other objectives are satisfied by a carrier head, for a semiconductor wafer polishing apparatus, which includes a rigid plate having a major surface. A wafer carrier membrane of soft, flexible material has a wafer contact section for contacting the semiconductor wafer. The wafer carrier membrane is connected to the rigid plate and extends across at least a portion of the major surface defining a cavity therebetween. A retaining ring is secured to the rigid plate around the wafer contact section of the wafer carrier membrane. A fluid conduit enables sources of vacuum and pressurized fluid to be connected alternately to the cavity.

In the preferred embodiment of the present invention, the major surface of the plate has a plurality of open channels which aid the flow of fluid between the plate and the wafer carrier membrane. For example, the major surface may have a plurality of concentric annular channels interconnected by a plurality of radially extending channels.

The preferred embodiment of the wafer carrier membrane has the wafer contact section surrounded by a bellows from which a flange outwardly extends. The flange is sandwiched between the major surface and the retaining ring to form the cavity.

During polishing the cavity is pressurized with fluid which causes the membrane to exert force against the semiconductor wafer pushing the wafer into an adjacent polishing pad. Because the wafer carrier membrane is very thin, soft and highly flexible, it conforms to the back surface of the semiconductor wafer which is opposite to the surface to be polished. By conforming even minute variations in the wafer surface, the membrane and exerts pressure evenly over the entire back surface of the semiconductor wafer thereby producing uniform polishing.

A lower edge of the retaining ring contacts the polishing pad and is substantially co-planar with the semiconductor wafer surface being polished. This co-planar relationship and the very small gap between the inner diameter of the retaining ring and the outer diameter of the semiconductor wafer significantly minimizes the edge abrasive effect encountered with prior polishing techniques. The retaining ring pre-compresses the polishing pad before reaching the edge of the semiconductor wafer. With only a very small gap between the retaining ring and the edge of the semiconductor wafer, the polishing pad does not expand appreciably in that gap so as to produce the edge abrasive effect previously encountered.

DETAILED DESCRIPTION OF THE INVENTION

Figure 1:
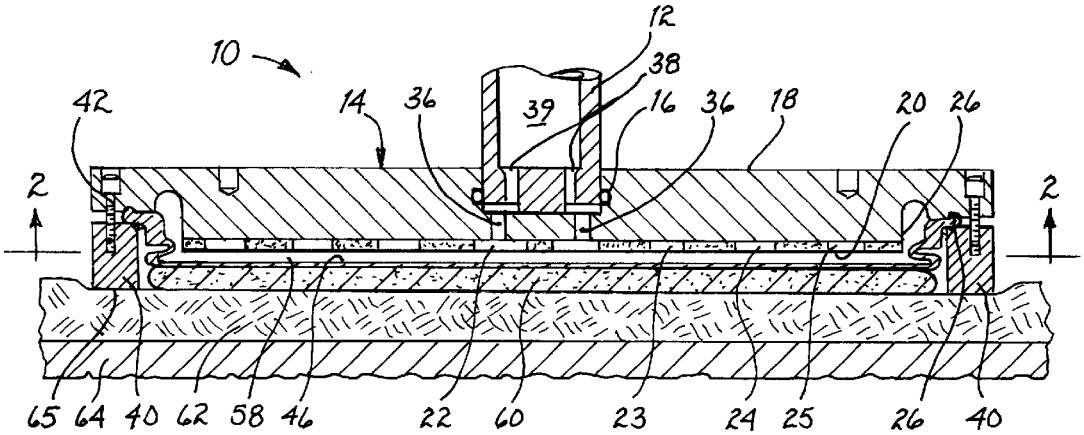
FIG. 1 is a diametric cross-sectional view through a wafer carrier according to the present invention.

With initial reference to FIG. 1, a semiconductor wafer polishing apparatus has a carrier head 10 mounted on a spindle shaft 12 that is connected to a rotational drive mechanism by a gimbal assembly (not shown). The end of the spindle shaft 12 is fixedly attached to a rigid carrier plate 14 with a flexible sealing ring 16 therebetween to prevent fluid from leaking between the spindle shaft and the carrier plate. The carrier plate 14 has a planar upper surface 18 and a parallel lower surface 20.

Figure 2:
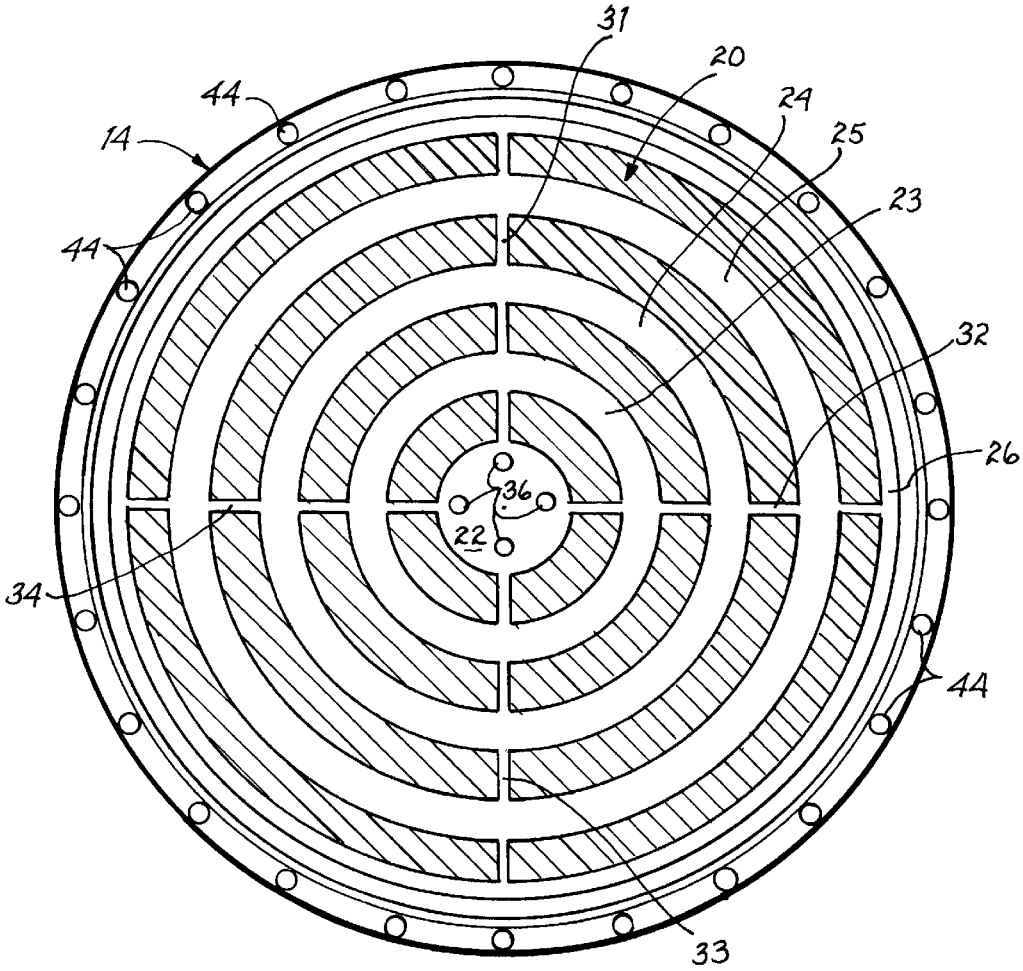
FIG. 2 is a cross-sectional view taken along line 2—2 of FIG. 1.

The lower surface 20 of the carrier plate 14 has a plurality of grooves therein as shown in FIG. 2. Specifically, the lower surface 20 has a central recessed area 22 with three spaced apart concentric annular grooves 23, 24 and 25 in order of increasing diameter. An annular recess 26 extends around the peripheral edge of the lower surface 20. Four axial grooves 31, 32, 33 and 34 extend at ninety degree intervals from the central recess 22 to the peripheral recess 26 through each of the annular grooves 23–25. Thus, each of the annular grooves, central recess, and peripheral recess communicate with each other through the axial grooves 31–34.

Four apertures 36 extend from the central recess 22 through the carrier plate 14 to a recess on the upper surface 18 in which the spindle shaft 12 is received, as seen in FIG. 1. Apertures 36 communicate with apertures 38 through the end of the spindle shaft 12 thereby providing a passage from a central bore 39 of the spindle shaft 12 to the underside of the carrier plate 14.

A retaining ring 40 is attached to the lower surface 20 of the carrier plate 14 at the peripheral recess 26. The retaining ring 40 is secured by a plurality of cap screws 42 which are received within apertures 44 that open into the peripheral recess 26 of the carrier plate 14. A circular wafer carrier membrane 46 is held between the carrier plate 14 and the retaining ring 40 stretching across the lower surface 20 of the carrier plate to form a flexible diaphragm beneath the carrier plate. The wafer carrier membrane 46 preferably is formed of molded polyurethane, although a thin sheet of any of several soft, resilient materials may be utilized.

Figure 3:
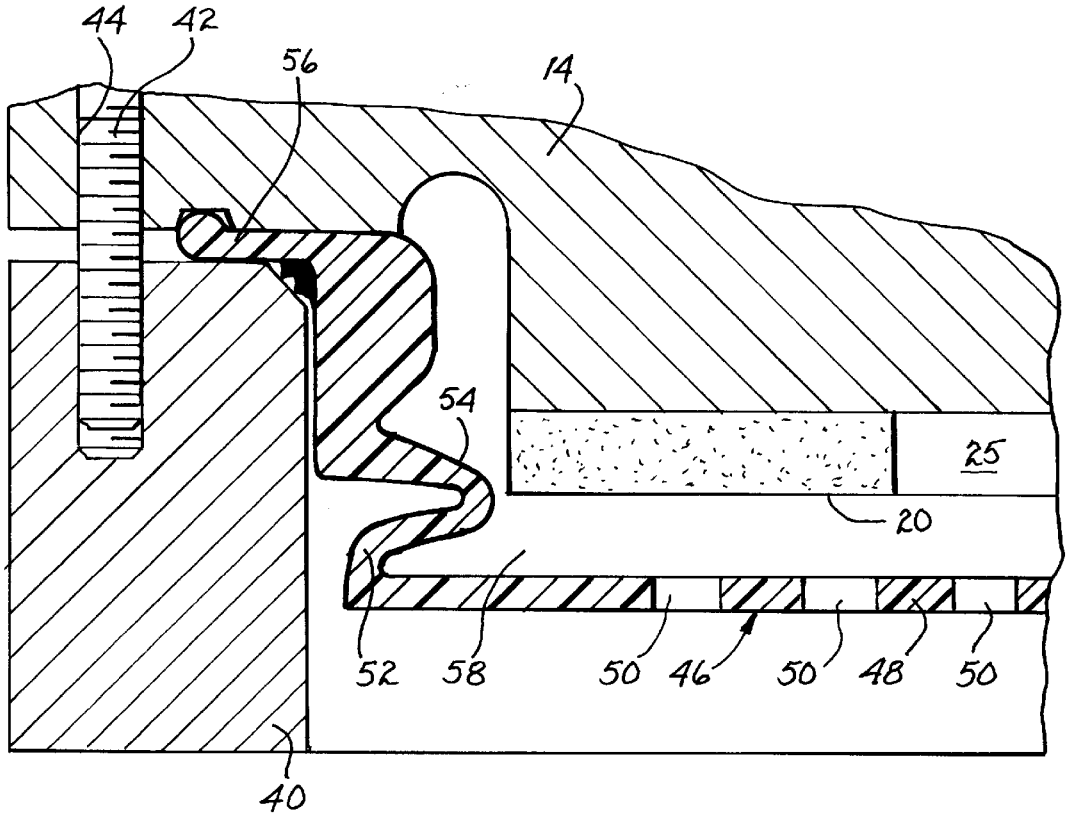
FIG. 3 is an enlarged cross-sectional view of a section of FIG. 1 showing details of the flexible wafer carrier membrane.

Referring in addition to FIG. 3, the flexible wafer carrier membrane 46 has a relatively planar, circular wafer contact section 48 with a plurality of apertures 50 extending therethrough. The central wafer contact section 48 is between 0.5 and 3.0 millimeters thick, for example 1.0 millimeter thick. The central wafer contact section 48 is bounded by an annular rim 52 which has a bellows portion 54 to allow variation in the spacing between the bottom surface 20 of the carrier plate 14 and the wafer contact section 48 of the membrane 46. The opposite edge of the rim 52 from the wafer contact section 48 has an outwardly extending flange 56 which is squeezed between the peripheral recess surface of the carrier plate 14 and the retaining ring 40 due to the force exerted by the cap screws 42.

In order to process a semiconductor wafer, the carrier head 10 is moved over a wafer storage area and lowered onto a semiconductor wafer 60. The spindle shaft 12 is connected to a vacuum source by a rotational coupling and valve (not shown). With the carrier head positioned over the semiconductor wafer 60, the vacuum valve is open which evacuates the cavity 58 formed between the carrier plate 14 and the wafer carrier membrane 46. This action draws air into this cavity 58 through the small holes 50 in the wafer carrier membrane 46 and creates suction which draws the semiconductor wafer 60 against the wafer carrier membrane. Although evacuation of chamber 58 causes the membrane to be drawn against the lower surface 20 of the carrier plate 14, the pattern of grooves 23–34 in that surface provide passageways for air to continue to be drawn through the holes 50 in the membrane 46 thereby holding the semiconductor wafer 60 against the carrier head 10. It should be noted that the interior diameter of the retaining ring 40 is less than five millimeters (preferably less than one to two millimeters) larger than the outer diameter of the semiconductor wafer 60.

The carrier head 10 and grabbed wafer 60 then are moved over a conventional semiconductor wafer polishing pad 62 which is mounted on a standard rotating platen 64, as shown in FIG. 1. The carrier head 10 then is lowered so that the wafer 60 contacts the surface of the polishing pad 62. Next the valve for the vacuum source is closed and a pressurized fluid is introduced into the bore 39 of the spindle shaft 12. Although this fluid preferably is a gas, such as dry air or nitrogen which will not react with the surface of the semiconductor wafer 60, liquids such as deionized water may be utilized. The fluid flows from the bore 39 through spindle shaft apertures 38 apertures 36 in the carrier plate 14 into the pattern of grooves 23–34 in the bottom surface 20 of the carrier plate 14 thereby filling the cavity 58 between the carrier plate and the flexible wafer carrier membrane 46. This action inflates the cavity 58 expanding the bellows 54 of the wafer carrier membrane 46 and exerts pressure against the semiconductor wafer 60. The fluid may be pressurized to less than 15 psi (preferably between 0.5 psi and 10 psi) with the precise pressure depending upon the characteristics of the semiconductor wafer 60 and the abrasive material applied to the polishing pad 62. The pressure from the fluid is evenly distributed throughout the cavity 54 exerting an even downward force onto the semiconductor wafer 60.

Because the membrane is very thin, it conforms to the top surface of the semiconductor wafer 60. The membrane 46 is soft and highly flexible conforming to even the minute variations in the wafer surface. As a consequence, a carrier film is not required between the wafer and the membrane as the membrane will conform to even minor surface contaminants on the back side of the semiconductor wafer 60.

During the polishing operation, the carrier head 10 is mechanically pressed downward so that the retaining ring 40 depresses the polishing pad 62. The lower edge 65 of the retaining ring 40 which contacts the polishing pad is substantially co-planar with the semiconductor wafer surface being polished. This co-planar relationship and the very small (<5 mm) difference between the inner diameter of the retaining ring 40 and the outer diameter of the semiconductor wafer 60 significantly minimizes the edge abrasive effect encountered with prior polishing techniques. This abrasive effect was due to depression of the polishing pad by the edge of the semiconductor wafer as it rotated against the pad. As seen in FIG. 1, the retaining ring 40 of the present carrier assembly depresses the polishing pad and because only a very small gap exists between the interior surface of the retaining ring 40 and the edge of the semiconductor wafer 60, the polishing pad does not expand appreciably in that gap thereby eliminating the sever edge abrasive effect previously encountered.

In addition, the present air pillow wafer carrier head 10 applies extremely uniform polish pressure across the entire are of the semiconductor wafer, especially at the edge of the wafer. The extreme flexibility and softness of the wafer carrier membrane 46 with the integral bellows 54 allows the carrier membrane 46 to respond to small disturbances on the face of the semiconductor wafer 60 which may be caused by some aspect of the polishing process such as pad variation, conditioning of the pad, and slurry flow rates. The flexible wafer carrier membrane is thus able to automatically compensate for such variations and provide uniform pressure between the semiconductor wafer 60 and the polishing pad 62. Any energy associated with these disturbances is absorbed by the fluid in the cavity 58 behind the wafer carrier membrane 46 instead of increasing the local polishing rate of the semiconductor wafer.

These features of the present wafer carrier head 10 produce uniform polishing across semiconductor wafer, enabling use of the entire wafer surface for circuit fabrication.

What is claimed is:

1. A carrier head for an apparatus which polishes a surface of a semiconductor wafer, wherein the carrier head comprises:

a rigid plate having a major surface;

a wafer carrier membrane of soft, flexible material with a wafer contact section for contacting the semiconductor wafer, the wafer carrier membrane connected to the rigid plate and extending across at least a portion of the major surface thereby defining a cavity therebetween, said wafer carrier membrane having a plurality of apertures through the wafer contact section;

a retaining ring secured to the rigid plate around the wafer contact section of the wafer carrier membrane; and a fluid conduit by which a source of a vacuum and a source of pressurized fluid are alternately connected to the cavity.

2. The carrier head as recited in claim 1 further comprising a fluid within the cavity, wherein the fluid has a pressure that is less than 15 psi.

3. The carrier head as recited in claim 1 wherein the wafer carrier membrane in the wafer contact section has a thickness between 0.5 and 3.0 millimeters, inclusive.

4. The carrier head as recited in claim 1 wherein the wafer contact section of the wafer carrier membrane is surrounded by a bellows which is coupled to the rigid plate.

5. The carrier head as recited in claim 4 wherein the wafer carrier membrane further comprises a flange extending around the bellows and abutting the rigid plate.

6. The carrier head as recited in claim 1 wherein the wafer carrier membrane further includes an annular bellows having a first end attached to the wafer contact section and having a second end, and a flange projecting from the second end and sandwiched between the major surface and the retaining ring.

7. The carrier head as recited in claim 1 wherein the rigid plate has a plurality of channels on the major surface and the fluid conduit communicates with the plurality of channels.

8. The carrier head as recited in claim 1 wherein the rigid plate his a plurality of concentric annular channels on the major surface.

9. The carrier head as recited in claim 8 wherein the rigid plate further includes a cross channel interconnecting the plurality of concentric annular channels.

10. The carrier head as recited in claim 8 wherein the rigid plate further comprises a plurality of radially extending channels on the major surface interconnecting the plurality of concentric annular channels.

11. The carrier head as recited in claim 1 wherein the semiconductor wafer has a first diameter; and the retaining ring has an inner diameter which is less than five millimeters larger that the first diameter.

12. The carrier head as recited in claim 1 wherein the semiconductor wafer has a first diameter; and the retaining ring has an inner diameter which is less than two millimeters larger that the first diameter.

13. The carrier head as recited in claim 1 wherein the retaining ring has a surface which is substantially coplanar with the surface of the semiconductor wafer.

14. The carrier head as recited in claim 1 further comprising a fluid within the cavity, wherein the fluid is selected from the group consisting of air, nitrogen and water.

15. A carrier head for an apparatus which polishes a semiconductor wafer, wherein the carrier head comprises:

a rigid plate having a major surface;

a wafer carrier membrane of flexible material having a wafer contact section for contacting the semiconductor wafer and having a plurality of apertures therethrough, and having an annular bellows projecting from wafer contact section and abutting the rigid plate;

a retaining ring connected to the rigid plate and the annular bellows thereby defining a cavity between the wafer carrier membrane and the rigid plate; and a fluid conduit through which a source of a vacuum and source of a pressurized fluid are alternately connected to the cavity.

16. A carrier head for an apparatus which polishes a semiconductor wafer, wherein the carrier head comprises:

a rigid plate having a major surface with a plurality of channels on the major surface;

a wafer carrier membrane of flexible material with a wafer contact section for contacting the semiconductor wafer and having a plurality of apertures therethrough;

a retaining ring secured to the rigid plate with a portion of the wafer carrier membrane sandwiched between the major surface and the retaining ring thereby defining a cavity between the wafer carrier membrane and the rigid plate; and a fluid conduit coupled to the plate by which sources of vacuum and pressurized fluid are alternately connected to the plurality of channels.

17. The carrier head as recited in claim 16 wherein the plurality of channels on the rigid plate comprises a plurality of concentric annular channels and a plurality of cross channels interconnecting the plurality of concentric annular channels.

18. The carrier head as recited in claim 15 wherein the annular bellows of the wafer carrier membrane has a flange extending therefrom and sandwiched between the major surface and the retaining ring.

19. The carrier head as recited in claim 15 wherein the rigid plate has a plurality of channels on the major surface.

* * * * *